US005247449A

United States Patent [19]

Yoshida

[11] Patent Number: 5,247,449

[45] Date of Patent: Sep. 21, 1993

[54] SEWING MACHINE HAVING A WIRELESS CONTROLLER

[75] Inventor: Noriyuki Yoshida, Nagoya, Japan

[73] Assignee: Brother Kogyo Kabushiki Kaisha, Nagoya, Japan

[21] Appl. No.: 767,484

[22] Filed: Sep. 30, 1991

[30] Foreign Application Priority Data

Oct. 4, 1990 [JP] Japan ..... 2-267900

[51] Int. Cl.[5] ..... G06F 15/46; D05B 69/36

[52] U.S. Cl. ..... 364/470; 112/277

[58] Field of Search ..... 364/470; 112/277, 121.11

[56] References Cited

U.S. PATENT DOCUMENTS 4,299,182 11/1981 Tanaka ..... 112/277

4,976,552 12/1990 Ishikawa et al. ..... 388/811

5,144,900 9/1992 Takahashi ..... 112/121.11

*Primary Examiner*—Jerry Smith

*Assistant Examiner*—Paul Gordon

*Attorney, Agent, or Firm*—Oliff & Berridge

[57] ABSTRACT

In a sewing machine having a remote battery powered foot pedal control, that communicates with the sewing machine proper via a wireless signal, a monitoring system that periodically monitors the status of the battery and provides that information from the foot pedal control, along with speed instructions, to the sewing machine proper. A display on the sewing machine informs the operator when battery change time is approaching and when replacement is urgently needed. If the battery is not replaced when replacement is urgent, the sewing machine ceases operations.

15 Claims, 7 Drawing Sheets

SEWING MACHINE HAVING A WIRELESS CONTROLLER

BACKGROUND OF THE INVENTION

1. Field of the Invention

The present invention relates to sewing machine and more particularly to a sewing machine having a machine body and a wireless controller provided independently of the machine body.

2. Description of Related Art

Conventionally, a wireless foot controller for a sewing machine having a pedal is known. The foot controller transmits an operating speed command, corresponding to an amount the pedal is depressed, to a control device provided in the machine body that adjusts the operating speed of the machine.

In such a foot controller, a battery is generally used as the power source. Accordingly, when the battery is at the end of its useful life, resulting in a reduction in output voltage, the transmission of the operating speed command becomes unstable, and finally, no longer occurs. As a result, the machine malfunctions by running continually and cannot be stopped and the speed cannot be changed because the signal cannot be transmitted. As a needle reciprocates during operation of the sewing machine, any malfunction, such as the runaway machine is very dangerous to an operator and could result in an accident.

SUMMARY OF THE INVENTION

It is an object of the present invention to provide a sewing machine, having a wireless controller, that can prevent an improper operation of a machine body of the sewing machine due to an erratic or lost power source for the wireless controller.

It is another object of the present invention to provide a sewing machine having a wireless controller that can inform an operator that the power source for the wireless controller has been consumed.

According to the invention, to achieve the above objects, there is provided a sewing machine comprising a machine body having receiving means for receiving operational information; control means for controlling the machine body according to the operational information received by the receiving means; a wireless controller provided independently of the machine body and having transmitting means for transmitting the operational information to the machine body; a power source for supplying an electric power to the wireless controller; detecting means for detecting an output condition of the power source; determining means for determining whether the power source has been consumed based on the output condition of the power source detected by the detecting means; and informing means for informing an operator that the power source has been consumed when the determining means determines that the power source has been consumed.

In the sewing machine of the present invention, the receiving means of the sewing machine receives the operational information transmitted by the transmitting means of the wireless controller. The control means of the sewing machine controls the sewing machine according to the operational information received by the receiving means. The power source supplies electric power to the wireless controller. The detecting means detects the output condition of the power source. The determining means determines whether the power source has been consumed based on the output condition of the power source detected by the detecting means. The informing means informs an operator that the power source has been consumed when the determining means determines that such is the case.

According to the sewing machine of the present invention, the operator is informed by the informing means that the power source for the wireless controller has been consumed or nearly so. Therefore, improper operation of the sewing machine due to consumption of the power source for the wireless controller is prevented.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

An embodiment will be described in which the invention is employed in a sewing machine having a foot controller.

Figure 1:
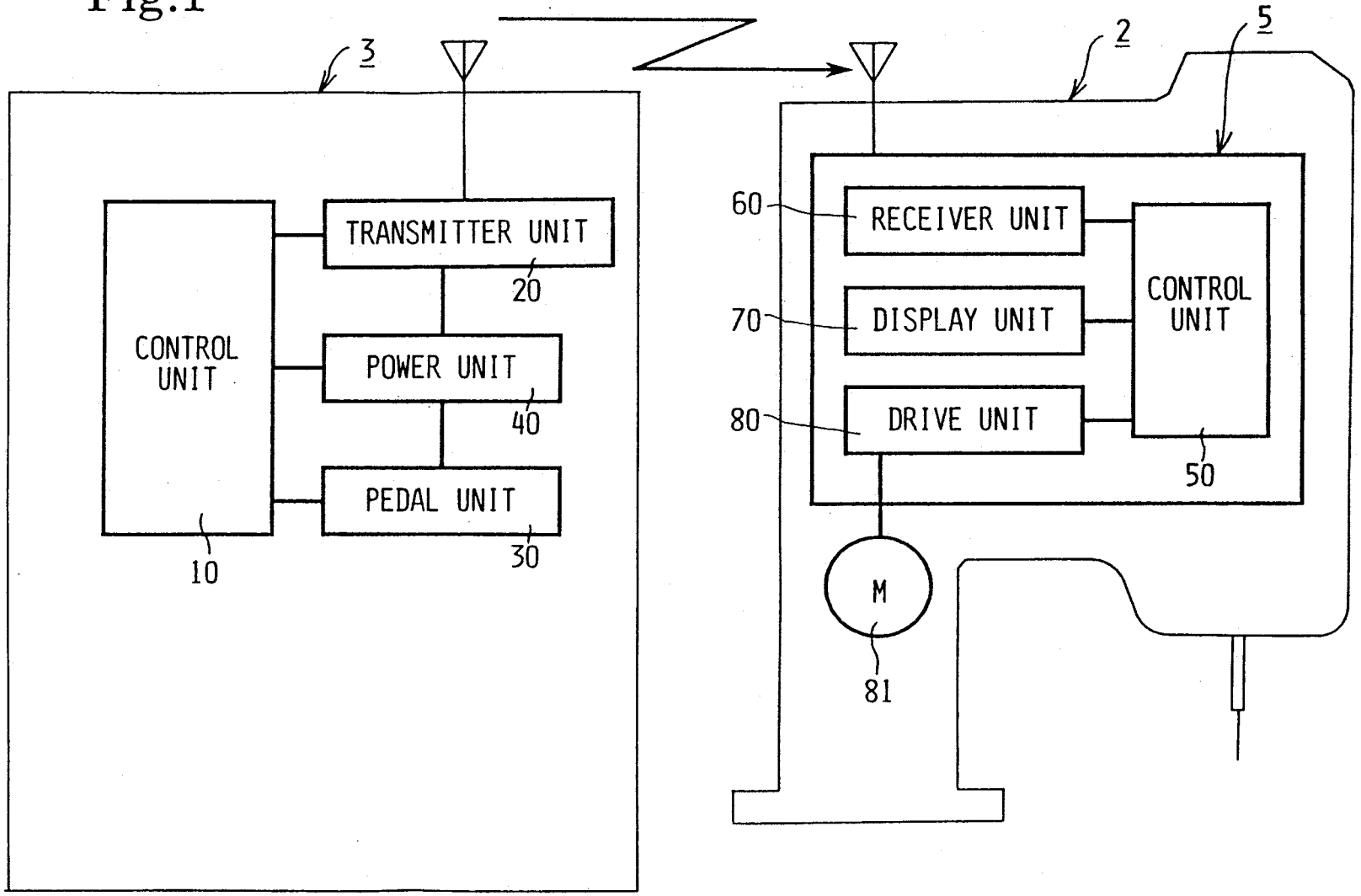
FIG. 1 is a schematic illustration of the sewing machine according to a preferred embodiment of the invention.

As shown in FIG. 1, the sewing machine according to the preferred embodiment has a sewing machine 2 and a foot controller 3. The foot controller 3 is accommodated in a controller box (not shown) formed independently of the sewing machine 2. The foot controller 3 includes a control unit 10, a transmitter unit 20, a pedal unit 30, and a power unit 40. The pedal unit 30 generates a signal for adjusting the operating speed of the sewing machine 2. The control unit 10 creates information for operating the sewing machine 2 according to the signal generated by the pedal unit 30. The transmitter unit 20 transmits the information created by the control unit 10 to a control device 5 in the sewing machine 2. The power unit 40 supplies electric power to the control unit 10, the transmitter unit 20, and the pedal unit 30.

The control device 5 is incorporated in the body of the sewing machine 2. The control device 5 includes a control unit 50, a receiver unit 60, a display unit 70, and a drive unit 80. The control unit 50 controls the operation of the sewing machine. The receiver unit 60 receives the information transmitted from the foot controller 3. The display unit 70 displays an operating mode of the sewing machine 2 and other messages. The drive unit 80 drives a machine motor 81.

The foot controller 3 will now be described in detail with reference to FIG. 2. The control unit 10 includes a CPU 10*b*, a ROM 10*c*, a RAM 10*d*, a timer 10*e*, and an input/output port 10*f* which are interconnected to one another by a bus 10*a*. These elements are all known in the art. The control unit 10 further includes a multiplexer 10*g* and an A/D converter 10*h* which are connected to the input/output port 10*f*. The multiplexer 10*g* selects one of plural input signals. The A/D converter 10*h* converts an analog voltage signal input from the multiplexer 10*g* to a digital signal. The input/output port 10*f* is connected through a data transmission bus 12 to the transmitter unit 20. The multiplexer 10*g* is connected to the pedal unit 30 and the power unit 40.

The ROM 10*c* stores a program for executing initializing processing such as clearing of a memory area or allocation of the input/output port 10*f* and programs for executing a power source monitoring process and an operating speed commanding process which will be further described. The ROM 10*c* also stores data representing a first reference voltage VR1, a second reference voltage VR2, and a voltage reduction rate K, to be described below. The RAM 10*d* includes a work area WA for data defined by the execution of the initializing process. The work area WA temporarily stores data representing a voltage signal VS and a difference value ΔV which will be described. The timer 10*e* can set a plurality of periods of time to be measured, in which the measurement of the periods can be individually started. The multiplexer 10*g* selects one of the input signals from the pedal unit 30 and the power unit 40, according to a select signal from the input/output port 10*f*, and then outputs the signal selected to the A/D converter 10*h*.

Figure 4:
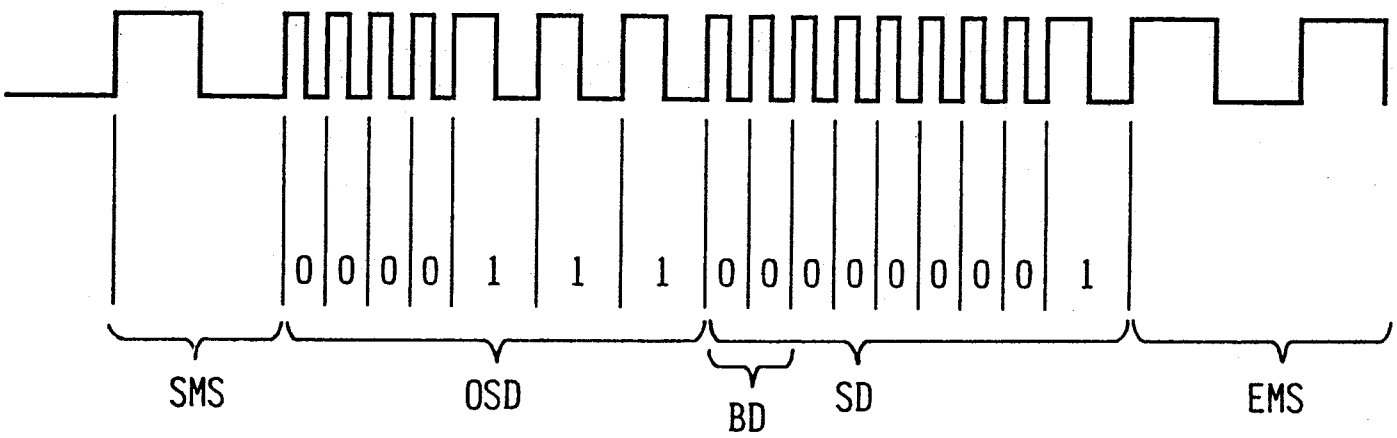
FIG. 4 is a diagram illustrating transmission data transmitted from the foot controller.

The transmitter unit 20 includes an encoder 20*a*, an FM modulator circuit 20*b* and a transmitting antenna 20*c*. The encoder 20*a* converts parallel data, including operating speed and status data input from the control unit 10 through the data transmission bus 12, into a serial bit pulse modulated in pulse width. The FM modulator circuit 20*b* modulates the frequency of a carrier wave by the serial bit pulse from the encoder 20*a* and transmits the frequency-modulated carrier wave from the transmitting antenna 20*c*. In the transmitter unit 20, the operating speed and status data, input from the input/output port 10*f* in the control unit 10 through the data transmission bus 12, constitute transmission data and this transmission data is transmitted to the control device 5 in the sewing machine 2. In the transmission data, as shown in FIG. 4, bit pulse having a short pulse width is represented as a bit 0 and the bit pulse having a long pulse width is represented as a bit 1. The operating speed data (OSD) has a 7-bit length, and the status data (SD) has a 9-bit length. The leftmost two bits of the status data are allocated for a battery data (BD) relating to replacement of the battery 40*a* provided in the power unit 40. A start mode signal (SMS) representing a start of the transmission data and an end mode signal (EMS) representing an end of the transmission data are represented by pulses having a width greater than that of the bit 1.

The pedal unit 30 includes a pedal 30*a* provided on an operation wall surface of the control box and a variable resistor 30*b*. The variable resistor 30*b* outputs a voltage signal VSP, according to an amount the pedal 30*a* is depressed, to the multiplexer 10*g* in the control unit 10.

The power unit 40 includes a stabilizer circuit 40*b* as well as the battery 40*a*. The stabilizer circuit 40*b* is supplied with electric power from the battery 40*a* and supplies a constant voltage Vcc to the control unit 10, the transmitter unit 20 and the pedal unit 30 irrespective of fluctuations with power consumption of each unit 10, 20 and 30. An output voltage of the battery 40*a* is generated as a voltage signal VBT through voltage dividing resistors R1 and R2 to the multiplexer 10*g* in the control unit 10. Because the voltage dividing resistors R1 and R2 have a large resistance, little current flows. Further, the stabilizer circuit 40*b* employs a known three-terminal regulator constructed by C-MOS which is operable by a very small power. Accordingly, the power unit 40 itself consumes very little electric power.

Figure 3:
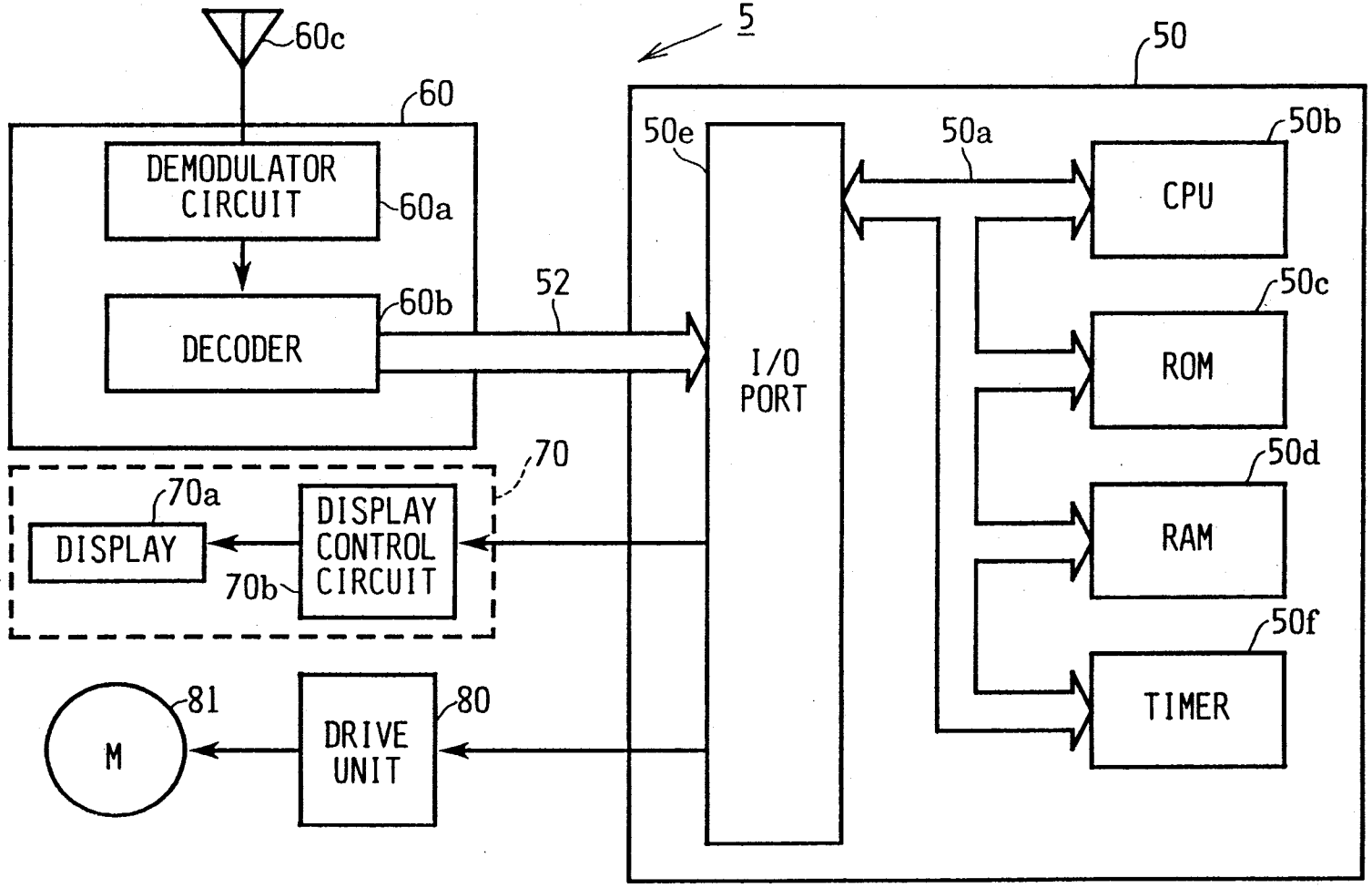
FIG. 3 is a block diagram illustrating the electrical structure of a machine body of the sewing machine.

The control device 5 in the body of the sewing machine 2 will now be described with reference to FIG. 3. The control unit 50 includes a CPU 50*b*, a ROM 50*c*, a RAM 50*d*, an input/output port 50*e* and a timer 50*f* which are interconnected to one another by a bus 50*a*. The input/output port 50*e* is connected through a data transmission bus 52 to the receiver unit 60. The input/output port 50*e* is also connected to the display unit 70 and the drive unit 80.

The ROM 50*c* stores programs for processing received data, a machine motor drive control process and a machine operation temporary stop process which will be described. The RAM 50*d* temporarily stores an operation stop flag F.

The receiver unit 60 includes a demodulator circuit 60*a*, a decoder 60*b*, and an antenna 60*c*. The demodulator circuit 60*a* receives a carrier wave transmitted from the foot controller 3, through the antenna 60*c*, and then demodulates the carrier wave to output a serial bit pulse to the decoder 60*b*. The decoder 60*b* converts the serial bit pulse into parallel data, and outputs the parallel data through the data transmission bus 52, to the input/output port 50*e* in the control unit 50.

The display unit 70 includes a display 70*a* and a display control circuit 70*b*. The display control circuit 70*b* controls the display 70*a* to display a machine operation mode and various messages such as a message of preparation for battery replacement or a message of urgent battery replacement, according to a display command signal from the control unit 50.

The drive unit 80 energizes the machine motor 81 according to a pulse signal input from the control unit 50.

Figure 5:
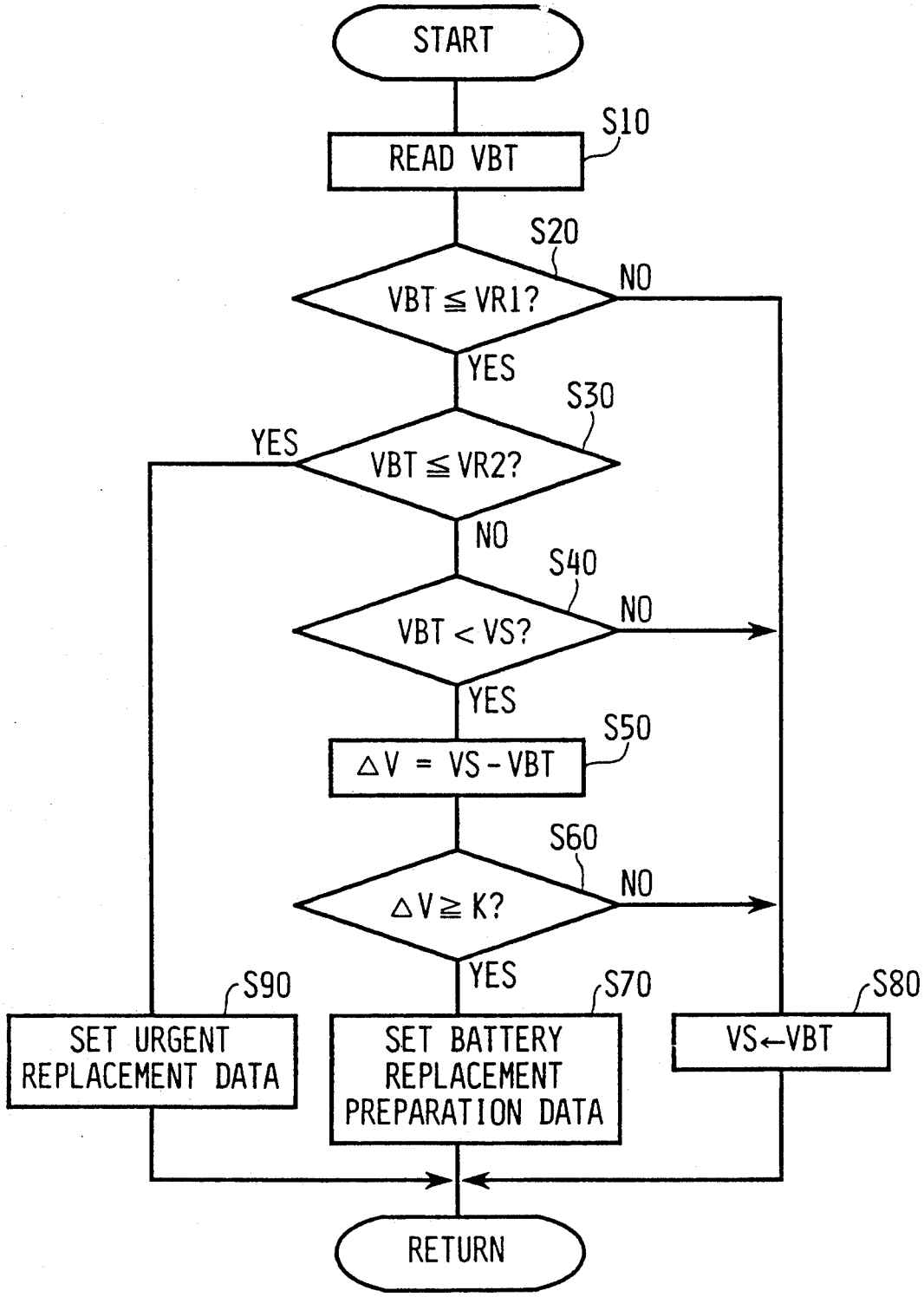
FIG. 5 is a flowchart of the power source monitoring process executed in the foot controller.

The power source monitoring process executed in the control unit 10 of the foot controller 3 will now be described with reference to the flowchart of FIG. 5. The power source monitoring process is repeatedly executed by the CPU 10*b* at a given cycle (such as 20 or 30 minutes, for example) according to a measuring time set by the timer 10*e*. When the power source monitoring processing is started, the voltage signal VBT from the power unit 40 is read in step S10. In step S20, it is determined whether the level of the voltage signal VBT is equal to or lower than the first reference voltage VR1 stored in the ROM 10*c* (VBT≦VR1 ?). The first reference voltage VR1 is established at a voltage level that when the power consumption is zero, an output voltage of the battery 40*a* can be restored to a rated voltage range. In step S20, if it is determined that the level of the voltage signal VBT is higher than the first reference voltage VR1, the program jumps to step S80. In step S20, if it is determined that the level of the voltage signal VBT is equal to or lower than the first reference voltage VR1, the program proceeds to step S30.

In step S30, it is determined whether the level of the voltage signal VBT is equal to or lower than the second reference voltage VR2 stored in the ROM 10*c* (VBT≦VR2 ?). The second reference voltage VR2 is set at a voltage level lower than that of the first reference voltage VR1, and this voltage level is a minimum rated voltage level ensuring the operation of the foot controller 3. Accordingly, in step S30, it is determined whether a dead state of the battery 40*a* is nearing. In step S30, if the answer is YES, that is, if it is determined that the dead state of the battery 40*a* is nearing, the program jumps to step S90. In step S30, if the answer is NO, that is, if it is determined that some time remains until the battery 40*a* approaches the dead state, the program proceeds to step S40. In step S40, it is determined whether the level of the voltage signal VBT is lower than the level of the previous voltage signal VS stored in the work area WA of the RAM 10*d* in the previous processing (VBT<VS ?). In step S40, if it is determined that the level of the voltage signal VBT is equal to or higher than the level of the previous voltage signal VS, the program jumps to step S80. In step S40, if it is determined that the level of the voltage signal VBT is lower than the level of the previous voltage signal VS, the program proceeds to step S50.

In step S50, a level difference between the previous voltage signal VS and the present voltage signal VBT is calculated as the difference value $\Delta V$ ($\Delta V = VS - VBT$) and the program then proceeds to step S60. The difference value $\Delta V$ corresponds to a voltage reduction rate. In step S60, it is determined whether the difference value $\Delta V$ is equal to or larger than the predetermined voltage reduction rate K stored in the ROM 10*c*. On this basis, it is determined whether the rate of consumption of the battery 40*a* is large. In step S60, if the answer is NO, that is, if it is determined that the rate of consumption of the battery 40*a* is small, the program goes to step S80. In step S60, if the answer is YES, that is, if it is determined that the degree of consumption of the battery 40*a* is large, the program proceeds to step S70. In step S70, battery replacement preparation data indicating that a time for replacing the battery 40*a* will come soon is set in the battery data that constitutes a part of the status data of the transmission data and that cycle of the power source monitoring process ends.

In the case where the program jumps from steps S20, S40 or S60 to step S80, the present voltage signal VBT is stored as the voltage signal data VS in a given portion of the work area WA of the RAM 10*d* and that cycle of the power source monitoring process ends.

In the case where it is determined in step S30 that the level of the voltage signal VBT is equal to or lower than the second reference voltage VR2, that is, it is determined that the dead state of the battery 40*a* is nearing, and the program jumps to step S90, an urgent replacement data indicating that urgent replacement of the battery 40*a* is required is set in the battery data and that cycle of the power source monitoring process ends.

Figure 6:
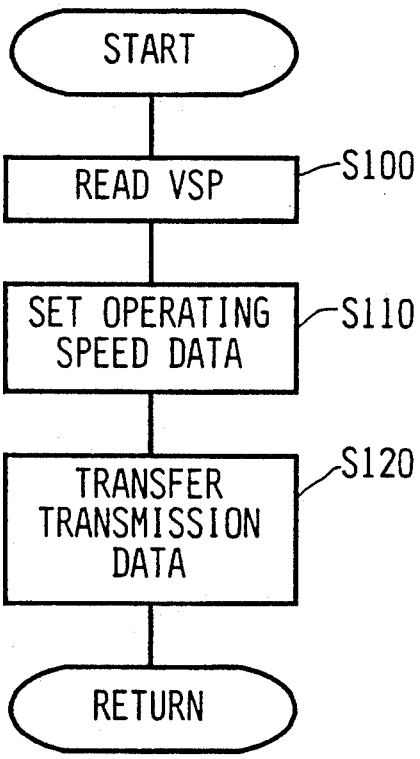
FIG. 6 a flowchart of the operating speed commanding process executed in the foot controller.

The operating speed commanding process executed in the control unit 10 of the foot controller 3 will now be described with reference to the flowchart shown in FIG. 6. The operating speed commanding process is repeatedly executed by the CPU 10*b* at a given cycle according to a measuring time set by the timer 10*e*. However, the execution cycle of the operating speed commanding process is sufficiently shorter (a period of milliseconds, for example) than the execution cycle of the aforementioned power source monitoring process. When the execution timing of the operating speed commanding process coincides with the execution timing of the power source monitoring process, the operating speed commanding process is executed first followed by execution of the power source monitoring process.

When the operating speed commanding process is started, the voltage signal VSP from the pedal unit 30 is read in step S100. The voltage signal VSP is of a level corresponding to the amount of depression of the pedal 30*a*. Next, an operating speed data corresponding to the level of the voltage signal VSP is set in step S110. Finally, in step S120, a transmission data is formed from the operating speed data set in step S110 and added to the status data which includes the battery data set by the aforementioned power source monitoring process. Then, the transmission data is transferred to the transmitter unit 20 and that cycle of the operating speed commanding process ends.

During execution of the power source monitoring process and the operating speed commanding process by the CPU 10*b*, when the degree of consumption of the battery 40*a* is large, the transmission data is formed from the operating speed data and the status data including the battery replacement preparation data, while when the dead state of the battery 40*a* is nearing, the transmission data is formed from the operating speed data and the status data including the urgent replacement data. The transmission data transferred to the transmitter unit 20 is transmitted from the transmitter unit 20 to the control device 5 in the body of the sewing machine 2.

Figure 7:
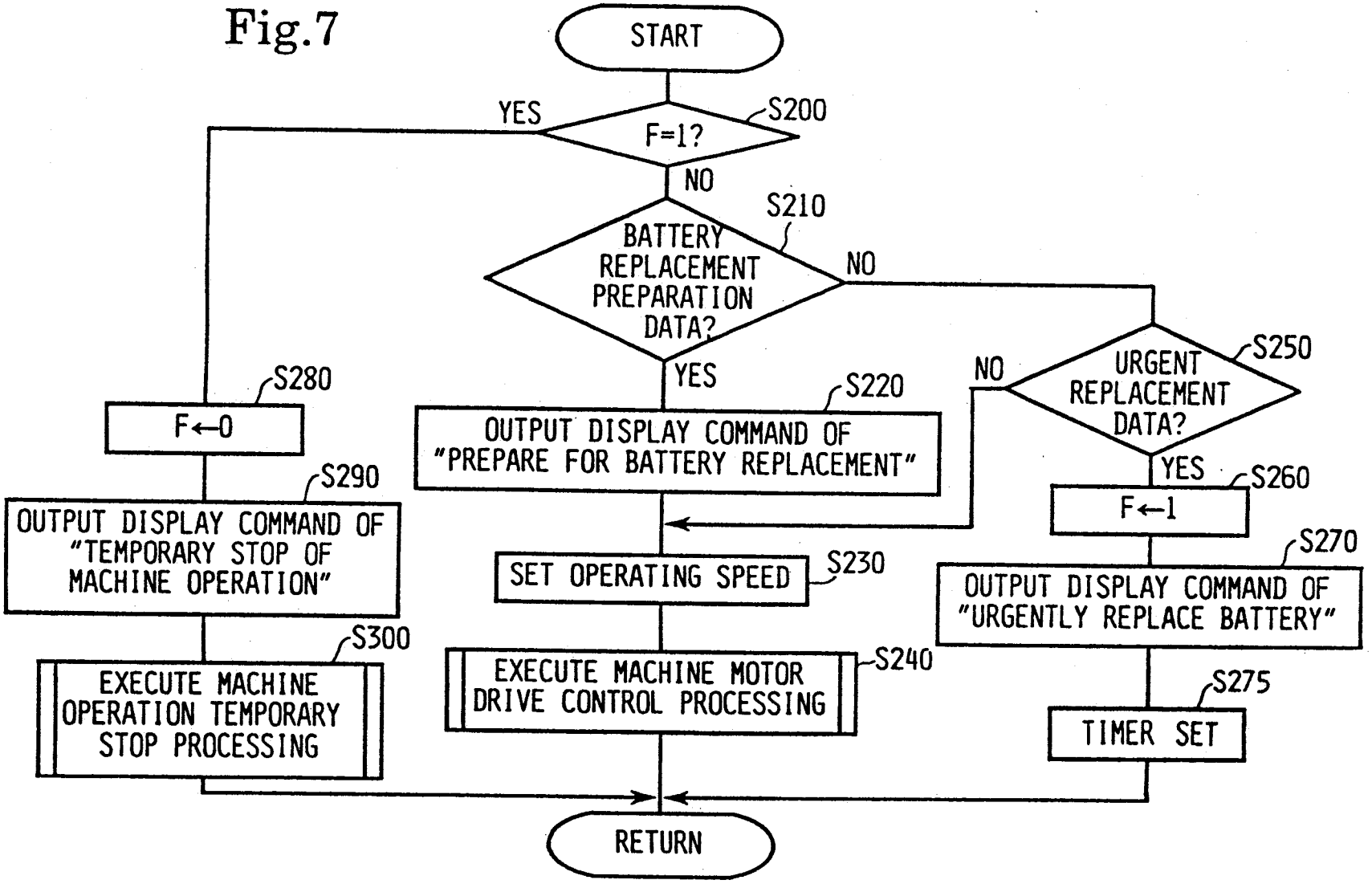
FIG. 7 is a flowchart of the processing of the received data for execution by the sewing machine.

When the receiver unit 60 in the control device 5 of the sewing machine 2 receives the transmission data from the foot controller 3, the control unit 50 processes the received data. Processing of the received data will be described with reference to the flowchart shown in FIG. 7. When processing of the received data is started by the CPU 50*b* of the control unit 50, it is determined in step S200 whether the operation stop flag F, stored in the RAM 50*d*, is at a set state of 1. If the answer in step S200 is YES, the program goes to step S280. If the answer in step S200 is NO, the program proceeds to step S210. In step S210, it is determined whether the battery data received is the battery replacement preparation data. If the answer in step S210 is NO, the program goes to step S250. If the answer in step S210 is YES, the program proceeds to step S220.

In step S220, a display command of "prepare for battery replacement" is output to the display unit 70. As a result, the display 70*a* driven by the display control circuit 70*b*, displays a message of "prepare for battery replacement". In step S230, the operating speed of the sewing machine 2 is set according to the operating speed data received. In step S240, a machine motor drive control process is executed and processing of the received data ends. As a result, the machine motor 81 is driven by the drive unit 80 at the operating speed set above until the next transmission.

In the case that the answer in step S210 is NO, and the program goes to step S250, it is determined in step S250 whether the battery data received is the urgent replacement data. If the answer in step S250 is NO, that is, if the battery 40*a* is normal such that no replacement of the battery 40*a* is required, the above described processings of step S230 and step S240 are executed and processing of the received data ends. If the answer in step S250 is YES, the program proceeds to step S260. In step S260, the operation stop flag F is set to 1 and is stored into the RAM 50*d*. Then, in step S270, a display command of "urgently replace battery" is output to the display unit 70, and in step S275, a measuring time (for example, five seconds) is set by the timer 50*f*. Thus, processing of the received data ends. As a result, the display 70*a* is driven by the display control circuit 70*b* to display the message "urgently replace battery" for the set measuring time.

In the case where it is determined in step S200 that the operation stop flag F is set at 1, and the program goes to step S280, the operation stop flag F is reset. Then, in step S290, a display command of "temporary stop of machine operation" is output to the display unit 70. As a result, the display 70*a* is driven by the display control circuit 70*b* to display the message "temporary stop of machine operation". Then, in step S300, a machine operation temporary stop process, for safely temporarily stopping the operation of the sewing machine 2 is executed and the processing of received data process ends. As a result, the machine motor 81 is temporarily stopped by the drive unit 80. Thus, when the battery 40*a* is not replaced, in spite of the display of the message of "urgently replace battery" in step S270, but sewing machine operation is continued, the operation of the sewing machine 2 is temporarily stopped in step S300, at the next operating speed commanding process cycle after the expiration of the measuring time, so as to prevent a malfunction of the sewing machine 2 and ensure the safety of an operator.

As described above, in this preferred embodiment, when the voltage signal VBT of the battery 40*a* becomes equal to or lower than the first reference voltage VR1, and the voltage reduction rate is equal to or larger than the predetermined voltage reduction rate K, the message of "prepare for battery replacement" is displayed. Further, when the voltage signal VBT becomes equal to or lower than the second reference voltage VR2, the message of "urgently replace battery" is displayed. Therefore, the operator is exactly informed of the degree of urgency for replacement of the battery 40*a*.

Further, the message of "prepare for battery replacement" or "urgently replace battery" informing the operator that the battery 40*a* in the foot controller 3 has been nearly consumed or consumed is displayed on the display 70*a* of the sewing machine 2 which is easily seen by the operator rather than on the foot controller 3 which is located at the operator's foot. Therefore, the operator is surely informed of the time for replacement of the battery 40*a*.

Further, when the battery 40*a* is not replaced in spite of displaying of the message of "urgently replace battery", operation of the sewing machine 2 is automatically stopped temporarily. Therefore, improper or unsafe operation of the sewing machine 2 is prevented.

Further, as both the first reference voltage VR1 and the second reference voltage VR2 are predetermined, when the voltage signal VBT of the battery 40*a* becomes equal to or lower than the first reference voltage VR1, the rate of voltage reduction, that is, the output reduction rate of the battery 40*a*, is compared with the predetermined voltage reduction rate K. Accordingly, a time of battery replacement can be properly determined and the operator informed according to a fluctuation in an output reduction characteristic of the battery 40*a* due to a temperature change or a change in kind of battery 40*a*.

For instance, when the temperature is 0° C., or the battery 40*a* is a lithium battery or an alkaline-manganese is normally small. Accordingly, even when the voltage signal VBT of the battery 40*a* becomes equal to or lower than the first reference voltage VR1, a certain time still remains until the battery must be replaced. In contrast, when the temperature is 50° C., or the battery 40*a* is a silver oxide battery or a mercury battery, the rate of voltage reduction of the battery 40*a* is rapid. Accordingly, when the voltage signal VBT of the battery 40*a* becomes equal to or lower than the first reference voltage VR1, little time remains until the battery must be replaced. In these circumstances, by determining whether the battery 40*a* has been consumed according to the rate of voltage reduction of the battery 40*a*, i.e., the output reduction characteristic of the battery 40*a*, when the voltage signal VBT of the battery 40*a* becomes equal to or lower than the first reference voltage VR1, a time for displaying of the message of "prepare for battery replacement" can be properly decided.

The invention is not limited to the above-mentioned preferred embodiment, but various modifications may be made without departing from the scope of the present invention.

Figure 2:
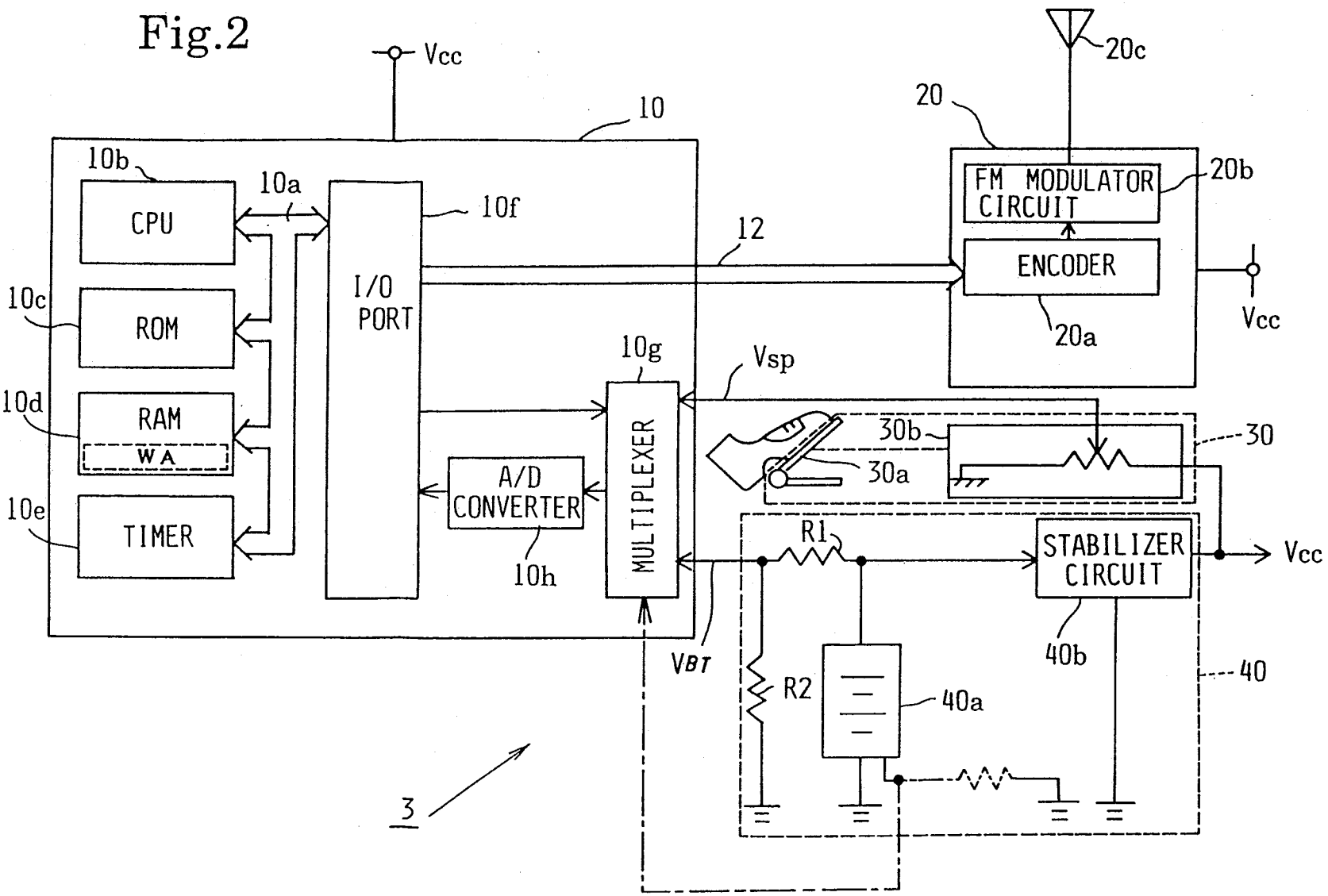
FIG. 2 is a block diagram illustrating the electrical structure of the foot controller of the sewing machine.

For instance, in the case where the power consumption of the foot controller 3 is temporarily increased to cause a reduction in the voltage signal VBT to the first reference voltage VR1 or less, a current detecting circuit may be provided as shown in FIG. 2 by the dashed line. In this case, when the consumed current detected by the current detecting circuit is equal to or more than a predetermined level, the execution of the power source monitoring process is deferred. After the consumed current becomes less than the predetermined level, and a time necessary for restoring the electromotive force and the output voltage of the battery 40*a* has elapsed, the execution of the power source monitoring process is restarted. With this structure, the time of battery replacement can be determined more accurately.

Further, a rechargeable battery may be used as well as a disposable battery as the battery 40*a*.

What is claimed is:

1. A sewing machine comprising:

a machine body having receiving means for receiving operational information and control means for controlling said machine body according to operational information received by said receiving means;

a wireless controller provided independently of said machine body and having transmitting means for transmitting operational information to said machine body;

a power source for supplying an electric power to said wireless controller;

detecting means for detecting an output condition of said power source;

determining means for determining whether said power source has been consumed based on the output condition of said power source detected by said detecting means; and informing means for informing an operator that said power source has been consumed when said determining means determines that said power source has been consumed.

2. The sewing machine according to claim 1, wherein said informing means includes displaying means provided in said machine body for displaying that said power source has been consumed.

3. The sewing machine according to claim 2, wherein said determining means includes calculating means for calculating an output reduction rate of said power source according to the output condition of said power source detected by said detecting means, whereby said determining means determines whether said power source has been consumed based on said output reduction rate calculated by said calculating means.

4. The sewing machine according to claim 3, wherein said determining means further determines when said power source is nearing an end of useful life based on said output reduction rate, and said informing means by means of said displaying means further informs the operator said power source is nearing the end of useful life when said determining means has so determined.

5. The sewing machine according to claim 1 further comprising:

stopping means for stopping said sewing operation of said machine body after said determining means determines that said power source has been consumed.

6. A sewing machine including a machine body, an operation commanding device formed independently of said machine body, and a control device incorporated into said machine body, said operation commanding device comprising:

operating means being manually operated for generating a signal for operating said machine body;

operational information creating means for creating operational information according to the signal generated by said operating means;

transmitting means for transmitting by wireless the operational information created by said operational information creating means;

a power source for supplying an electric power to said operating means, said operational information creating means, and said transmitting means;

detecting means for detecting an output condition of said power source;

calculating means for calculating an output reduction characteristic of said power source based on the output condition detected by said detecting means;

determining means for determining whether said power source has been consumed based on said output reduction characteristic calculated by said calculating means; and power source consumption information creating means for creating power source consumption information when said determining means determines that said power source has been consumed and for supplying the power source consumption information to said transmitting means, wherein said transmitting means transmits by wireless the power source consumption information; and said control device comprising:

receiving means for receiving said operational information transmitted by said transmitting means of said operation commanding device;

operation control means for controlling an operation of said machine body based on the operational information received by said receiving means; and informing means for informing an operator that said power source of said operation commanding device has been consumed when the power source consumption information is received by said receiving means.

7. The sewing machine according to claim 6, said control device further comprising stopping means for automatically ceasing sewing operations after the operator has been informed said power source has been consumed and said determining means confirms said power source has been consumed.

8. The sewing machine according to claim 6, wherein said determining means further determines when said power source is nearing an end of useful life based on said output reduction characteristic, said power source consumption creating means creates further power source consumption information that said power source is nearing the end of useful life, and said informing means informs the operator said power source is nearing the end of useful life.

9. The sewing machine according to claim 6, wherein said power source includes a battery and said output condition is an output voltage of said battery.

10. The sewing machine according to claim 9, wherein said detecting means detects said output voltage with respect to a first reference voltage and a second reference voltage.

11. The sewing machine according to claim 10, wherein when said output voltage is detected by said detecting means as one of less than and equal to both said first and second reference voltages, said determining means determines replacement of said battery is urgently required and said power source consumption information creating means creates an urgent replacement battery consumption information.

12. The sewing machine according to claim 10, wherein when said output voltage is greater than first reference voltage, said determining means determines said battery is not consumed and sets a previous output voltage equal to said output voltage.

13. The sewing machine according to claim 10, wherein when said output voltage is one of less than and equal to said first reference voltage and said output voltage is greater than said second reference voltage, said determining means determines whether said output voltage is less than a previous output voltage.

14. The sewing machine according to claim 13, wherein when said output voltage is less than said previous output voltage, said calculating means calculates said output reduction characteristic and said determining means determines whether said output reduction characteristic is one of greater than and equal to a predetermined voltage reduction rate and when the answer is yes, determines said battery is consumed.

15. The sewing machine according to claim 14, wherein when said determining means determines one of said output voltage is greater than said previous output voltage and said output reference characteristic is less than said predetermined voltage reduction rate, said determining means determines said battery is not consumed and sets said previous output voltage equal to said output condition.

* * * * *